US005735059A

United States Patent [19]

Schmit et al.

[11] Patent Number: 5,735,059

[45] Date of Patent: Apr. 7, 1998

[54] DRYING CYLINDER POSITIONING FOR DRYER SECTION

[75] Inventors: Anton Schmit; Georg Kugler, both of Heidenheim; Markus Oechsle, Bartolomae, all of Germany

[73] Assignee: Voith Sulzer Papiermaschinen GmbH, Germany

[21] Appl. No.: 651,464

[22] Filed: May 23, 1996

[30] Foreign Application Priority Data

Jun. 9, 1995 [DE] Germany ..... 295 09 461.3

[51] Int. Cl.[6] ..... F26B 5/04

[52] U.S. Cl. ..... 34/117; 34/116

[58] Field of Search ..... 34/114, 115, 116, 34/117, 120, 123

[56] References Cited

U.S. PATENT DOCUMENTS 5,144,758 9/1992 Skaugen et al. ..... 34/117

5,325,608 7/1994 Mayer ..... 34/114

5,572,801 11/1996 Ahokas et al. ..... 34/117

5,590,476 1/1997 Alakoski et al. ..... 34/117

*Primary Examiner*—Henry A. Bennett

*Assistant Examiner*—Pamela A. O'Connor

*Attorney, Agent, or Firm*—Ostrolenk, Faber, Gerb & Soffen, LLP

[57] ABSTRACT

In a dryer section comprised of several drying groups, and particularly an alternating single tier dryer section, one of the bottom felted drying groups is arranged with respect to the paper machine floor so at least the rotating shafts at the axis of the drying cylinders of the one drying group are below the paper machine floor. The guide rolls of the bottom felted drying group and of an adjacent top felted drying group may be in one horizontal shaft plane above the paper machine floor. An intermediate floor is provided beneath the main machine floor and the bottom of the basement beneath the one drying group. Easier access to the drying cylinders and elements of both top felted and bottom felted drying groups is obtained.

13 Claims, 1 Drawing Sheet

DRYING CYLINDER POSITIONING FOR DRYER SECTION

BACKGROUND OF THE INVENTION

The present invention relates to a dryer section of a paper machine, and particularly to the location of some of the drying cylinders below the floor of the paper machine.

A dryer section includes a series of drying cylinders about which a paper web to be dried is wrapped, a dryer fabric or felt which presses the web against the drying cylinders and, where there is a single row or single tier dryer group, web and felt guide rolls between successive drying cylinders along the web path. The single tier groups are frequently top felted, i.e., the bottom side of the web contacts the drying cylinders. Sometimes, some of the dryer groups are arranged so that the top side of the web contacts the drying cylinders, i.e., a bottom felted group. In such a drying section, a top felted group and a bottom felted group follow one another.

Such arrangements are known from U.S. Pat. No. 5,325,608, in which the structural height necessary for the dryer section and, as a result, the accessibility to the upper drying cylinders may not be satisfactory.

The same observation applies to the dryer section proposed in U.S. Pat. No. 5,144,758, an object of which patent is to simplify the construction of such dryer sections and minimize the distance between the drying cylinders and the guide rolls.

SUMMARY OF THE INVENTION

The object of the present invention is therefore to provide a dryer section which has the advantages of the prior art, yet is of shorter structural height and also, insofar as possible, provides improved accessibility.

According to the invention, the shafts of the drying cylinders of one of the drying groups of a dryer section, particularly the bottom or lowest cylinders, as in a bottom felted single tier drying group, are all located approximately in the same plane. That plane is horizontal and is below the floor of the paper machine. For greatest simplification, the guide rolls which are present between the drying cylinders of all single tier drying groups in a drying section which is comprised of several single tier drying groups should be arranged approximately in the same horizontal plane.

Access to the shafts of the lower drying cylinders, e.g., the cylinders of the bottom felted dryer group, can be assured or improved via cut-outs in the paper machine floor. This is important particularly because of the drive of these drying cylinders and to provide them with steam. In this connection, it is advantageous to provide an intermediate floor between the paper machine floor and the floor of the basement beneath the dryer section, at least along the region in which the shafts of the drying cylinders are present below the paper machine floor.

Other objects and features of the invention are explained with reference to an embodiment shown in the accompanying drawings.

DETAILED DESCRIPTION OF A PREFERRED EMBODIMENT

Figure 1:
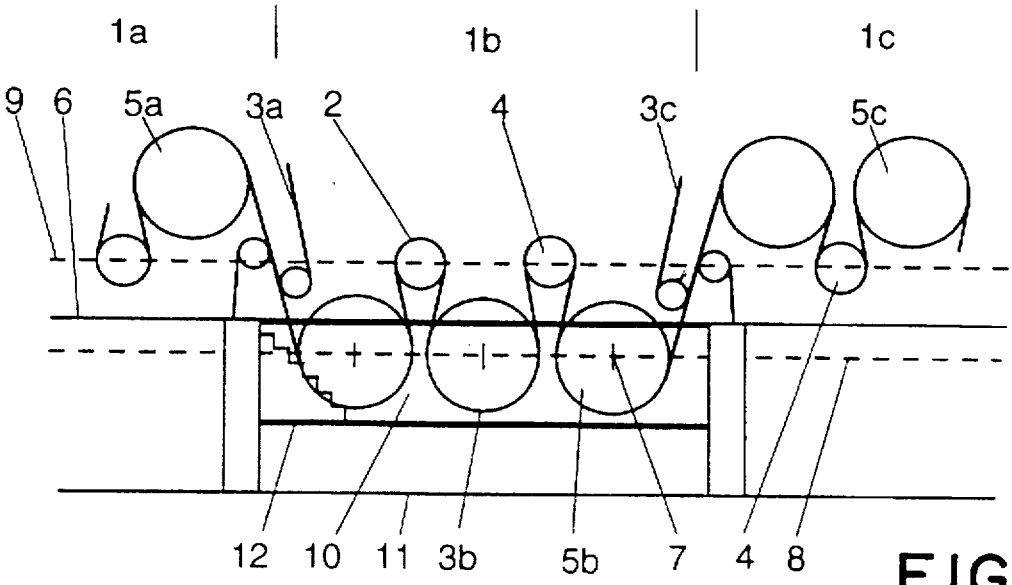
FIG. 1 is a diagrammatic longitudinal cross section through a part of dryer section.
Figure 2:
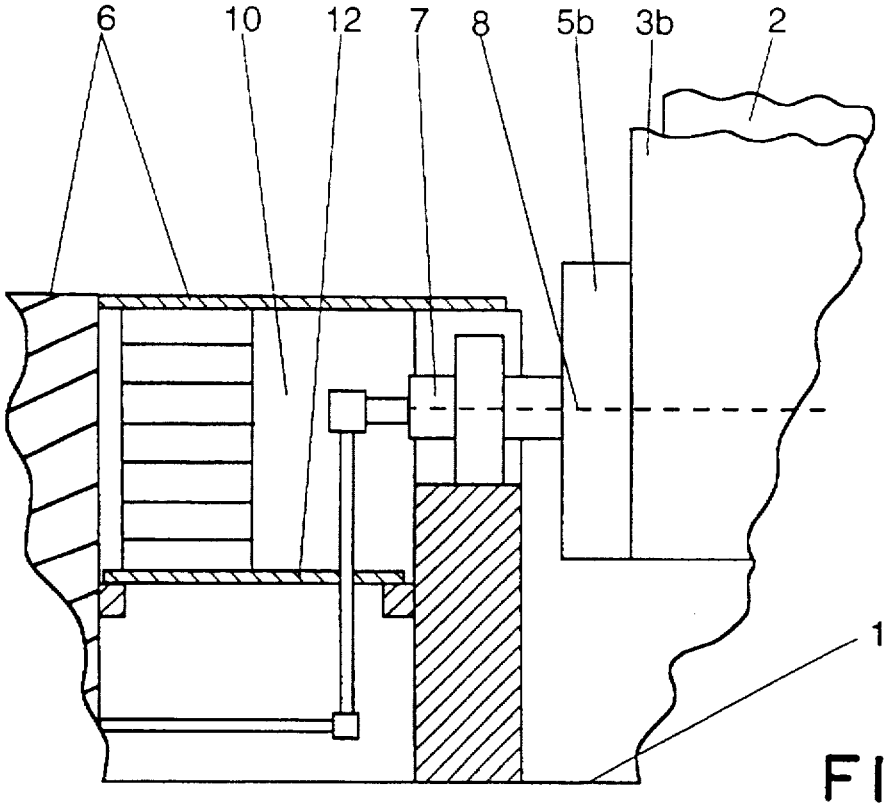
FIG. 2 is a diagrammatic transverse view of the region of the mounting of a lower drying cylinder.

In FIG. 1, the illustrated dryer section includes more than two single tier or single row drying groups 1*a*, 1*b*, 1*c* through which a web of paper 2 is guided, together with respective endless dryer wires or felts 3*a*, 3*b*, 3*c* respectively associated with the corresponding drying group 1*a*, 1*b*, 1*c*. The felts move alternately over guide rolls 4 in the form of suction guide rolls and then over heated drying cylinders 5*a*, 5*b*, 5*c*. The paper web 2 is held between the corresponding dryer wire 3*a*, 3*b*, 3*c* and the drying cylinder 5*a*, 5*b*, 5*c* so that in each drying group, only one side of the paper web 2 comes in contact with the drying cylinders 5*a*, 5*b*, 5*c* in the drying groups 1*a*, 1*b*, 1*c*. That web side varies from illustrated drying group to group. In this connection, all of the guide rolls 4 present between adjacent drying cylinders 5*a*, 5*b*, 5*c* of the corresponding drying group 1*a*, 1*b*, 1*c* are shown located in one plane 9 a distance above the paper machine floor 6. This simplifies construction. It applies to successive top felted and bottom felted drying groups in the dryer section.

The illustrated second drying group is a bottom felted group, wherein the top side of the web wraps under the successive drying cylinders and the dryer felt returns below the drying cylinders. Further, the axes of the guide rolls 4 are generally above the axes or shafts of the cylinders 5 to achieve desired wrapping of the cylinders by the web. The shafts 7 of the drying cylinders 5*b* of the bottom felted drying group 1*b* shown in the middle in FIG. 1 are arranged in a horizontal plane 8 below the paper machine floor 6. Because the height of the lower row of drying cylinders has been dropped with reference to the machine floor, the height above the paper machine floor 6 of the drying cylinders 5*a*, 5*c* of the adjacent top felted dryer groups 1*a*, 1*c*, which cylinders are arranged substantially above their guide rolls 4, is reduced. As a result, the accessibility of the upper drying cylinders 5*a*, 5*c* of groups 1*a* and 1*c* is improved. On the other hand, the overall height of the dryer section with reference to the machine floor is substantially reduced.

In order to permit good accessibility for personnel to the drying cylinders 5*b* of the middle drying group 1*b*, which cylinders are arranged at the bottom, the paper machine floor 6 has a cut-out region 10 in the region of the lower group of drying cylinders 5*b* or at least in their mounting regions. An intermediate floor 12 is present between the paper machine floor 6 and the floor 11 of the basement beneath the drying section. The intermediate floor can be reached, for instance, by stairs from the paper machine floor 6. This enables the mounting region together with the drive, the steam supply, etc. of the corresponding drying cylinders 5*b*, to be accessible without any problem.

The transfer of the paper web 2 between the drying groups 1*a*, 1*b*, 1*c* may be effected, as described inter alia in U.S. Pat. No. 5,144,758, without an open path of the paper web 2. However, the invention applies to a drying section with open paths or draws between adjacent groups. Guidance of the dryer wires 3*a*, 3*b*, 3*c* is effected by other guide rolls not shown. Also, the invention is not restricted to the illustrated arrangement with all of the guide rolls 4 in one horizontal plane. The guide rolls of successive groups may also be on different planes, for ease of construction, easing transfers between successive groups, optimizing heights and providing access from the floor or a supported catwalk, etc. For other details of drying section construction with alternating top and bottom groups, the teachings thereof from U.S. Pat. No. 5,144,758 are incorporated herein by reference.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A dryer section of a paper making machine, the dryer section being comprised of several drying groups, wherein each of the drying groups includes at least one drying cylinder and a drying felt associated with the drying cylinder for holding the web to be dried against the drying cylinder;

at least one of the drying groups comprises a plurality of drying cylinders in succession along the path of the web through the one drying group and guide rolls for the dryer felt each located between an adjacent pair of dryers of the one dryer group;

each of the drying cylinders of the one group having a respective shaft about which the dryer rotate;

the paper machine having a main floor; the drying cylinders of the one group being so located that at least the shafts thereof are located below the floor of the paper machine.

2. The dryer section of claim 1, wherein the shafts of the drying cylinders of the one group are so placed that the shafts are below the floor of the paper machine and the top regions of the drying cylinder of the one group are above the paper machine floor.

3. The drying section of claim 1, wherein the one dryer group is a bottom felted single tier dryer group and the guide rolls between adjacent drying cylinders have axes that are disposed above the shafts of the drying cylinders of the one drying group.

4. The drying section of claim 1, wherein the paper machine floor includes cut-outs for providing access to the shafts of the drying cylinders of the one drying group and to a portion of the drying cylinders below the machine floor.

5. The drying section of claims 4, wherein there is a cellar beneath the one group of drying cylinders and the cellar having a floor beneath the one group of cylinders;

an intermediate floor located between the floor of the paper machine and the cellar floor, the intermediate floor being located in the region of the shafts of the drying cylinders of the one drying group.

6. A dryer section of a paper making machine, the dryer section being comprised of several drying groups, wherein each of the drying groups includes at least one drying cylinder and a drying felt associated with the drying cylinder for holding the web to be dried against the drying cylinder;

at least one of the drying groups comprises a plurality of drying cylinders in succession along the path of the web through the one drying group and guide rolls for the dryer felt between adjacent dryers of the one dryer group;

each of the drying cylinders of the one group having a respective shaft about which the dryer rotate;

the paper machine having a main floor; the drying cylinders of the one group being so located that at least the shafts thereof are located below the floor of the paper machine, wherein the shafts of the drying cylinders of the one group are so placed that the shafts are below the floor of the paper machine and the top regions of the drying cylinder of the one group are above the paper machine floor and the shafts of the one group of drying cylinders are in the same plane below the floor.

7. The drying section of claim 6, wherein the paper machine floor includes cut-outs for providing access to the shafts of the drying cylinders of the one drying group and to a portion of the drying cylinders below the machine floor.

8. A drying section of a paper making machine, the dryer section being comprised of several drying groups, wherein each of the drying groups includes at least one drying cylinder and a drying felt associated with the drying cylinder for holding the web to be dried against the drying cylinder;

at least one of the drying groups comprises a plurality of drying cylinders in succession along the path of the web through the one drying group and guide rolls for the dryer felt between adjacent dryers of the one dryer group;

each of the drying cylinders of the one group having a respective shaft about which the dryer rotate;

the paper machine having a main floor; the drying cylinders of the one group being so located that at least the shafts thereof are located below the floor of the paper machine, wherein the one dryer group is a bottom felted single tier dryer group and the guide rolls between adjacent drying cylinders have axes that are disposed above the shafts of the drying cylinders of the one drying group and the guide rolls of the one drying group are entirely above the floor of the paper machine.

9. The drying section of claim 8, wherein a second one of the dryer groups is adjacent to and the web travels directly between the second drying group and the one drying group; the second drying group also comprising second drying cylinders, having shafts so that the second drying cylinders are above the floor of the paper machine; the second drying group having respective second guide rolls between the second drying cylinders, the second guide rolls also being above the floor of the paper machine, the axes of the second guide rolls being below the axis of the second drying cylinder.

10. The drying section of claim 9, wherein the axes of the guide rolls of both of the first and the second drying groups are arranged approximately in the same plane and above the paper machine floor.

11. The drying section of claim 8, wherein the paper machine floor includes cut-outs for providing access to the shafts of the drying cylinders of the one drying group and to a portion of the drying cylinders below the machine floor.

12. A dryer section of a paper making machine, the dryer section being comprised of several drying groups, wherein each of the drying groups includes at least one drying cylinder and a drying felt associated with the drying cylinder for holding the web to be dried against the drying cylinder;

at least one of the drying groups comprises a plurality of drying cylinders in succession along the path of the web through the one drying group and guide rolls for the dryer felt between adjacent dryers of the one dryer group;

each of the drying cylinders of the one group having a respective shaft about which the dryer rotate;

the paper machine having a main floor; the drying cylinders of the one group being so located that at least the shafts thereof are located below the floor of the paper machine, wherein there is a cellar beneath the one drying group of drying cylinders and the cellar having a floor beneath the one group of cylinders;

an intermediate floor located between the floor of the paper machine and the cellar floor, the intermediate floor being located in the region of the shafts of the drying cylinders of the one drying group.

13. The drying section of claim 12, wherein the paper machine floor includes cut-outs for providing access to the shafts of the drying cylinders of the one drying group and to a portion of the drying cylinders below the machine floor.

* * * * *